US007647656B2

(12) United States Patent
Smith

(10) Patent No.: US 7,647,656 B2
(45) Date of Patent: Jan. 19, 2010

(54) SEGMENTED SLEEPING BAG SYSTEM

(76) Inventor: Patrick D. Smith, 16036 W. Ellsworth La., Golden, CO (US) 80401

( * ) Notice: Subject to any disclaimer, the term of this patent is extended or adjusted under 35 U.S.C. 154(b) by 293 days.

(21) Appl. No.: 11/536,518

(22) Filed: Sep. 28, 2006

(65) Prior Publication Data

US 2008/0078027 A1 Apr. 3, 2008

(51) Int. Cl.
*A47G 9/08* (2006.01)

(52) U.S. Cl. ..... 5/413 R; 5/413 AM

(58) Field of Classification Search ..... 5/413 R, 5/494, 413 AM, 485–486, 413; 2/69.5
See application file for complete search history.

(56) References Cited

U.S. PATENT DOCUMENTS 4,103,377 A * 8/1978 Mayer et al. ..... 2/69.5
4,125,910 A 11/1978 Nicholai
4,158,892 A 6/1979 Gonzales
4,484,362 A 11/1984 Asher
4,507,805 A 4/1985 Calutoiu
4,574,397 A 3/1986 Dennard
4,575,876 A 3/1986 Weaver
5,533,216 A * 7/1996 Thier ..... 5/413 R
5,588,749 A 12/1996 Ishikawa
5,611,082 A 3/1997 Bull
5,815,833 A * 10/1998 Kuo ..... 2/69.5
6,018,830 A * 2/2000 Howe ..... 5/413 R
6,061,831 A 5/2000 Rudolph et al.
6,334,221 B1 1/2002 Hope
6,393,637 B1 5/2002 Hoffman
6,671,903 B2 1/2004 Bowers et al.

* cited by examiner

*Primary Examiner*—Fredrick C. Conley
(74) *Attorney, Agent, or Firm*—Dorsey & Whitney LLP

(57) ABSTRACT

A segmented sleeping bag is provided that can be used as a sleeping bag or can be transversely separated into constituent parts for alternative uses. In one alternative, one or more of the constituent parts may be used with a host sleeping bag to provide enhanced performance properties. In another alternative, one or more of the constituent parts of the segmented sleeping bag may be used as an article of clothing, such as a parka or cagoule.

23 Claims, 13 Drawing Sheets

SEGMENTED SLEEPING BAG SYSTEM

FIELD OF THE INVENTION

Aspects of the present invention relate to a sleeping bag having a variety of uses. More particularly, the present invention, in certain aspects, is a segmented sleeping bag usable as a sleeping bag with or without a host sleeping bag, and usable as an article of clothing when separated into constituent parts.

BACKGROUND OF THE INVENTION

Hunters and other outdoors oriented people often sleep in sleeping bags. Various types of sleeping bags may be used depending on the season. For example, in the summer, a relatively lightweight sleeping bag may be used that keeps an individual comfortable in warm weather, and because of its lightness, is easy to carry. In the fall and winter seasons, an individual may be required to hunt or camp with a heavier, more cumbersome sleeping bag, i.e. due to more insulation filling and bulk, in order to stay comfortable in colder climates. In addition, hunters and campers also travel with other camping gear such as a backpack containing extra clothing, cooking provisions, hunting gear, and a tent. Hunting and camping with a large amount of camping gear can make it difficult for a person to hike long distances, because the more weight the person carries, the more fatigued a person becomes in a shorter period of time. As a result, a person planning on hiking a long distance may decide to forego certain camping provisions in order to reduce the amount of weight they have to carry. This may be problematic for some, because the camping provisions left behind may be required in order to maintain a person's well-being and/or comfort.

Accordingly, there is a need to provide campers with the ability to travel with versatile camping gear that meets a person's seasonal comfort requirements for sleeping while controlling the amount of bulk and weight a person travels with.

BRIEF SUMMARY OF THE INVENTION

Various embodiments of the invention address the issues described above by providing a sleeping bag system that may be configured in a variety of ways in order to provide a camper with a preferred comfort level, while at the same time controlling the bulk and weight of the sleeping bag.

Certain implementations also provide a dual-purpose camping provision in which a sleeping bag is provided with connectable segments, and when one or more segments are separated, they serve as an article of clothing, thereby eliminating the need for a person to travel with both a sleeping bag and jacket, and also reducing the amount of bulk and weight a person needs to carry.

Another embodiment provides a multi-purpose segmented sleeping bag that includes an upper portion, a middle portion, and a lower portion. The upper portion includes two closure mechanisms that extend longitudinally along each side in order to provide arm access for a user's arms to extend there through. An integrated hood is disposed at a proximal end of the upper portion and includes an adjustable opening allowing a user's head to be selectively exposed. A lower edge of the upper portion defines an opening. The middle portion forms a sleeve for surrounding a portion of the user's torso and legs and has a proximal end configured to be releasably coupleable to a distal end of the upper portion. The lower portion forms a sleeve with an open proximal end that is configured to be releasably coupleable to a distal end of the middle portion, and a closed distal end for surrounding and enclosing a user's feet and part of their legs. When the middle portion is coupled to the upper portion and to the lower portion, a hollow elongated sleeping bag is provided. When the upper portion and middle portion are coupled and the lower portion detached, a cagoule is formed. When the top portion stands alone, a parka is formed.

In accordance with another aspect of the invention, a sleeping bag system is provided that includes a host sleeping bag and a segmented sleeping bag or overbag having an upper portion, a middle portion, and a lower portion. The middle portion is releasably attached to the upper portion at a first end, and is releasably attached to the lower portion at a second end. The host sleeping bag of the sleeping bag system is configured to detachably couple to one or more of the upper, middle, and lower portions of the segmented sleeping bag. In some embodiments, the host sleeping bag and an upper portion, separated from the middle and lower portions, are releasably coupled. In other embodiments, just the middle portion or just the lower portion, separated from the rest of the segmented sleeping bag, is releasably coupled to the host sleeping bag. In farther embodiments, when the segmented sleeping bag is assembled with the upper portion, middle portion, and lower portions, it provides a hollow elongated sack in which the host sleeping bag can be placed. In this configuration the assembled segmented sleeping bag and the host sleeping bag may optionally be releasably coupled to each other.

According to yet another implementation of the invention, a multi-purpose article for providing heat retention comprises an outer sleeping bag parka that includes at least two sealable arm openings, an integrated hood section, at least one pocket, at least one resealable closure tab for defining a shoulder portion, and one or more sets of releasable connectors configured to couple to other camping provisions. In addition, the outer sleeping bag parka defines an elongated sleeve terminating at one end by integrating with the integrated hood section and open at the other end to provide an access opening having an adjustable circumference.

These and other features and advantages of aspects of the present invention will become apparent to those skilled in the art from the following detailed description, wherein it is shown and described illustrative embodiments, including best modes contemplated for carrying out the invention. As it will be realized, the various aspects of the invention are capable of modifications in various obvious respects, all without departing from the spirit and scope of the present invention. Accordingly, the drawings and detailed description are to be regarded as illustrative in nature and not restrictive.

DETAILED DESCRIPTION OF THE INVENTION

Certain embodiments of the invention provide a segmented sleeping bag configured to include detachable portions usable as an article of clothing and usable in combination with a host sleeping bag in order to provide compartmentalized use of the detachable portions.

Figure 1A:
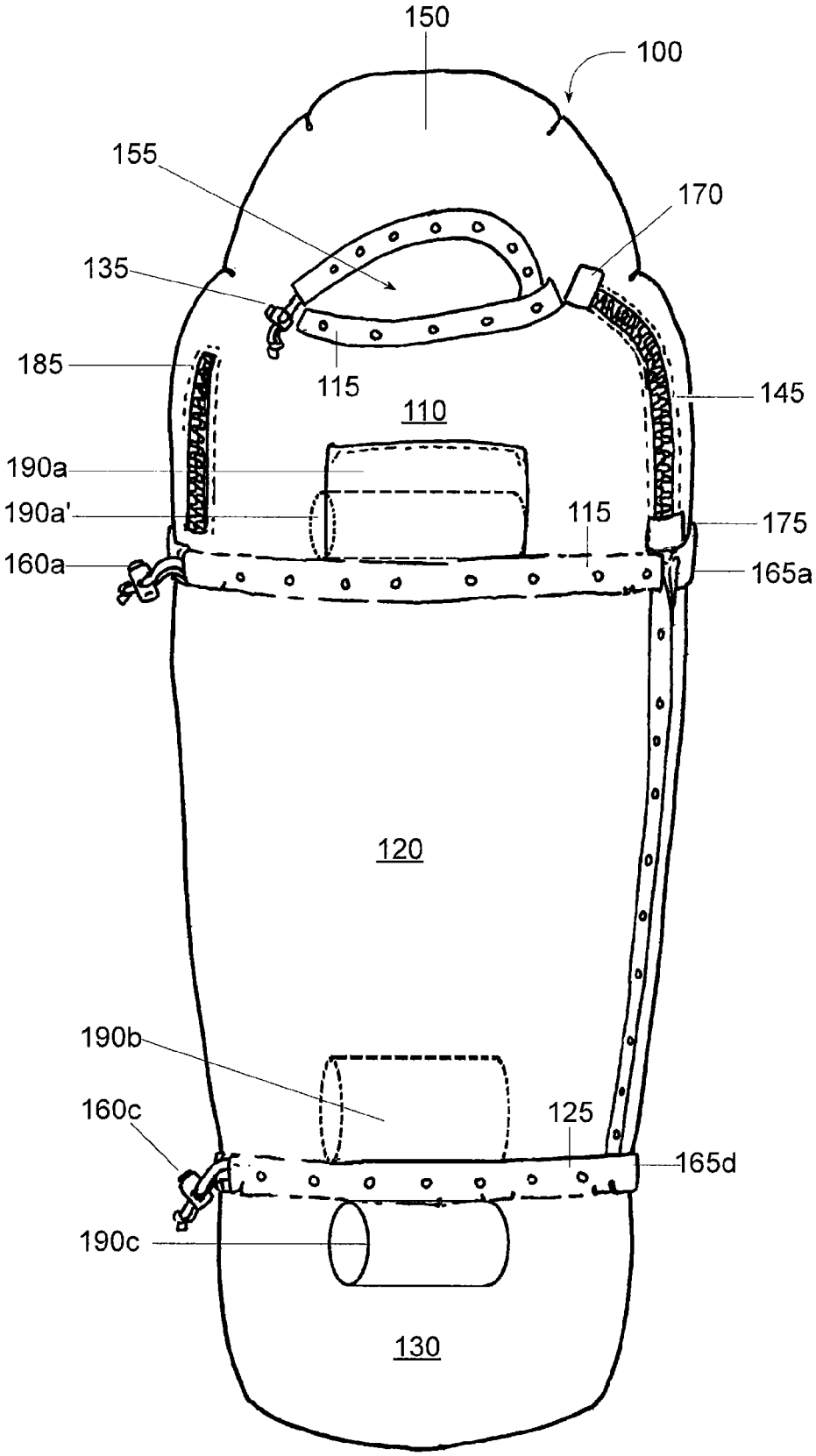
FIG. 1*a* provides an illustration of a segmented sleeping bag.

FIG. 1*a* provides an illustration of a segmented sleeping bag 100 according to one embodiment. Segmented sleeping bag 100 includes an upper portion 110 for covering a person's head and surrounding a portion of their torso, a middle portion 120 for surrounding a person's body from about their lower torso to about their knees, and a lower portion 130 for surrounding a person's legs from about their knees down around their feet. Middle portion 120 of segmented sleeping bag 100 is coupled to upper portion 110 via releasable connectors 115 at one end, and to lower portion 130 via releasable connectors 125 at the other end.

Segmented sleeping bag 100 further includes zipper closure 145 that extends along a longitudinal length of upper portion 110 in order to provide access to the segmented sleeping bag 100 when assembled, as in FIG. 1*a*. Upper portion 110 also includes a drawstring 135 that extends along the circumference of the opening of hood 150 so that the size of opening 155 can be adjusted. In addition, closure tabs 170 and 175 provide bag closure mechanisms for upper portion 110, and zipper closure 185, located along another longitudinal length of upper portion 110, may provide an opening for a user's arm to extend through, which is described further below.

Middle portion 120 additionally includes releasable connectors that extend longitudinally along its length. Coupling releasable connectors along the length of middle portion 120 enables middle portion 120 to be formed into a hollow elongated sleeve.

Figure 5A:
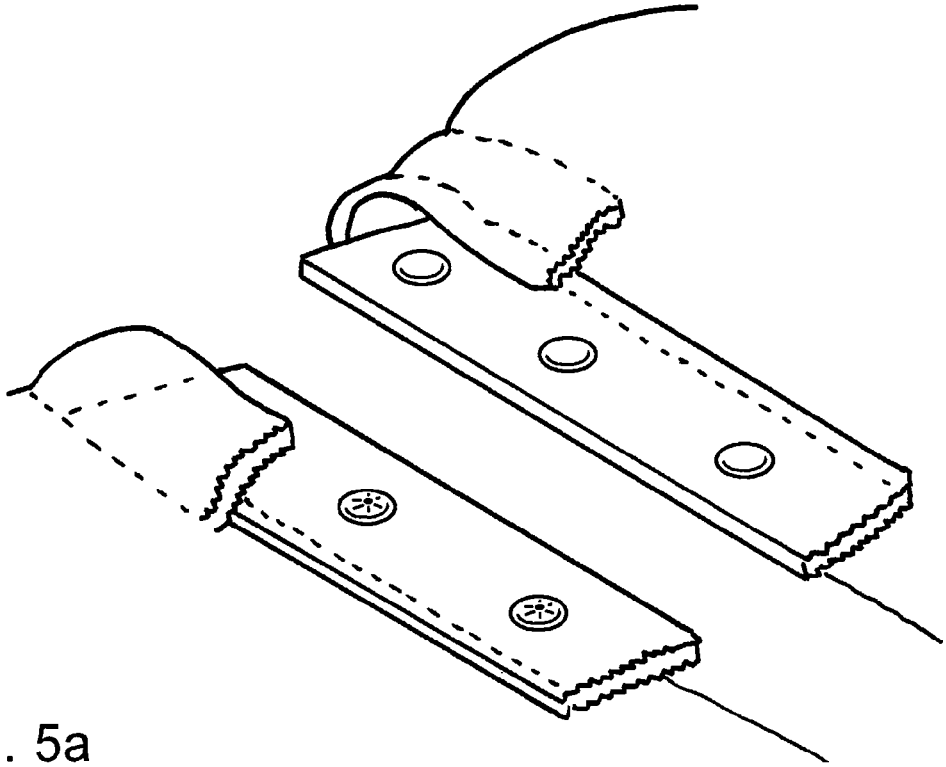
FIGS. 5*a*-5*e* depict exemplary embodiments of releasable closure mechanisms for use with a segmented sleeping bag.
Figure 5B:
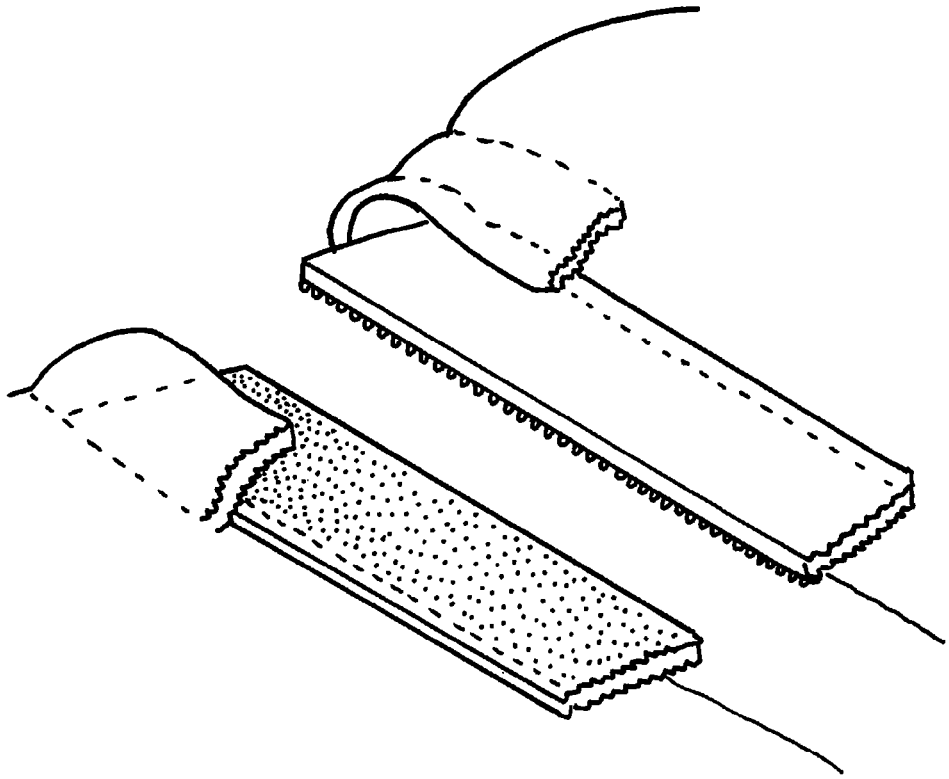

According to aspects of the invention, releasable connectors may include zippers (FIG. 5*e*), snaps (FIG. 5*a*), e.g., quick snaps that are easily broken apart and manufactured by Yale Hook and Eye Co., of Newark, N.J., hook and loop closures (FIG. 5*b*), and loop lacing (FIGS. 5*c* and 5*d*), for example. However, it should be understood that a variety of mechanisms may be used to provide releasable connectors, as described above and below, in addition to those described above. For example, any zippers used may either be non-locking zippers, easy-grab zippers or safety zippers. Moreover, zippers, snaps, or other closure mechanisms used may be of the type that allows the user to quickly open the segmented sleeping bag 100, and may be positioned on the inside of segmented sleeping bag 100 so that the closure mechanisms are easily accessible.

Furthermore, each segment of the segmented sleeping bag 100 may include a pocket 190*a*-*c*, and each may be situated on an exterior or interior of segmented sleeping bag 100. Pockets 190*a*-*c* may be used to stuff and store their respective portions of the bag, or may be used for other storage, for example. In some implementations, additional pockets or storage structures may be included on segmented sleeping bag 100. For example, pocket 190*a*' may be affixed in an interior of upper portion 110, or in an interior of pocket 190*a*, and may be used for holding a tablet and pen or pencil. In another example, pocket 190*a*' may be used to stuff and store upper portion 110, and pocket 190 may be used for other storage.

Figure 1B:
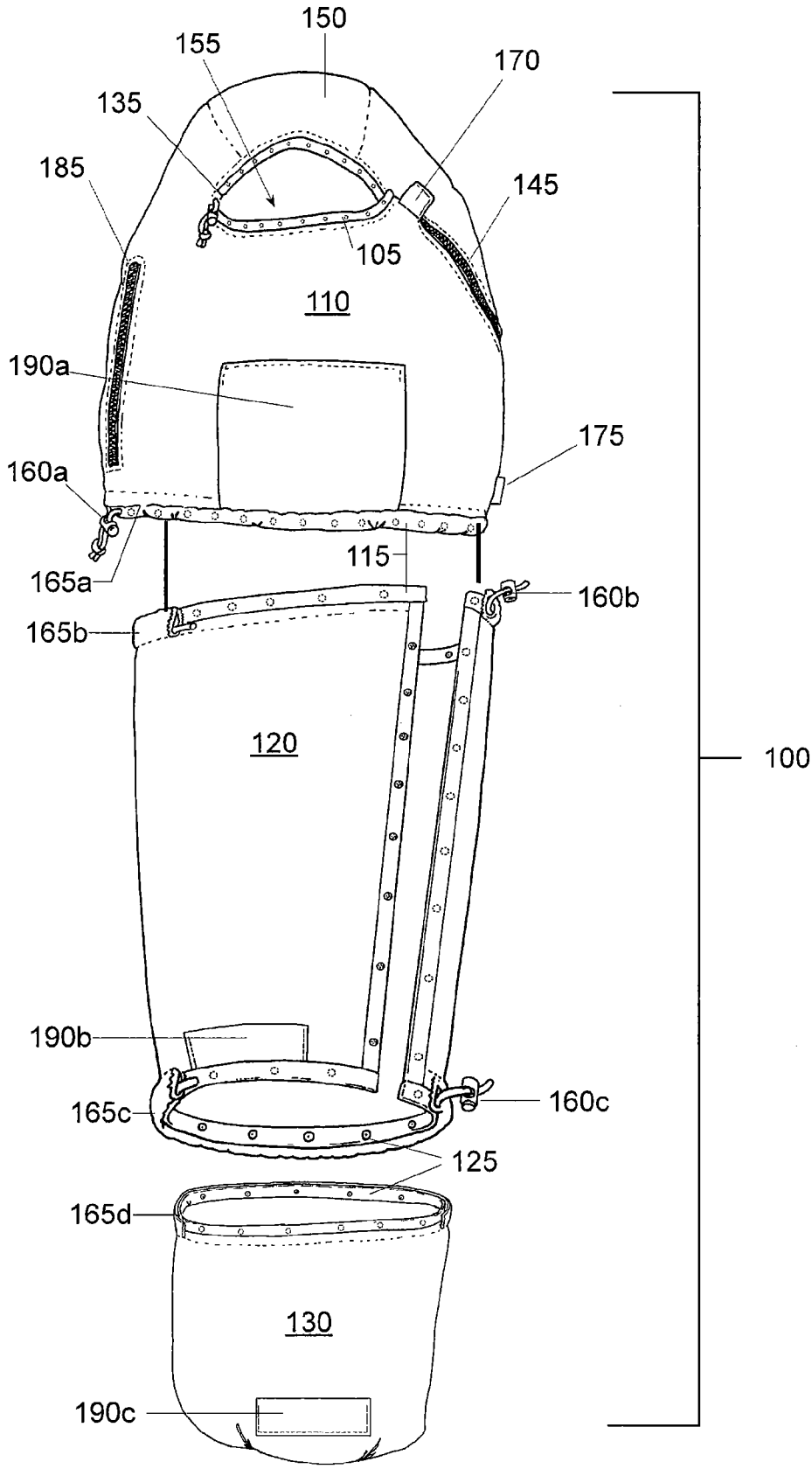
FIG. 1*b* provides an illustration of a segmented sleeping bag separated into its constituent parts.
Figure 5C:
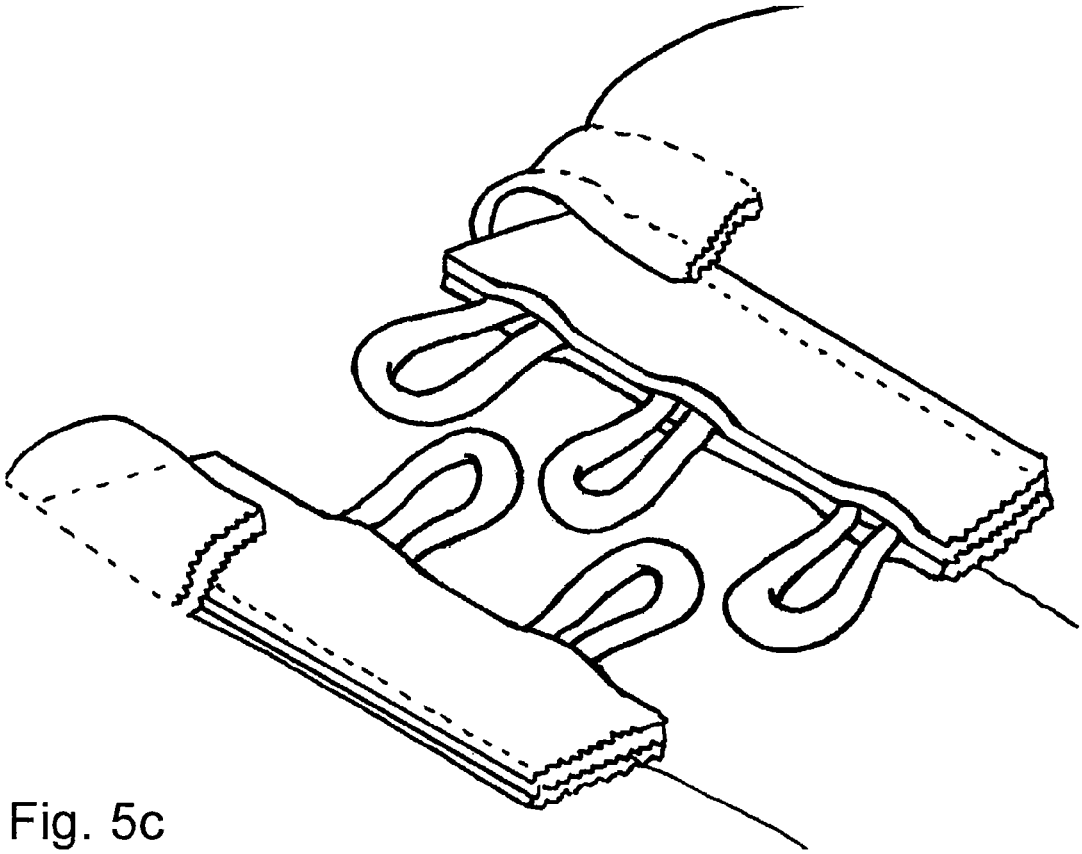
Figure 5D:
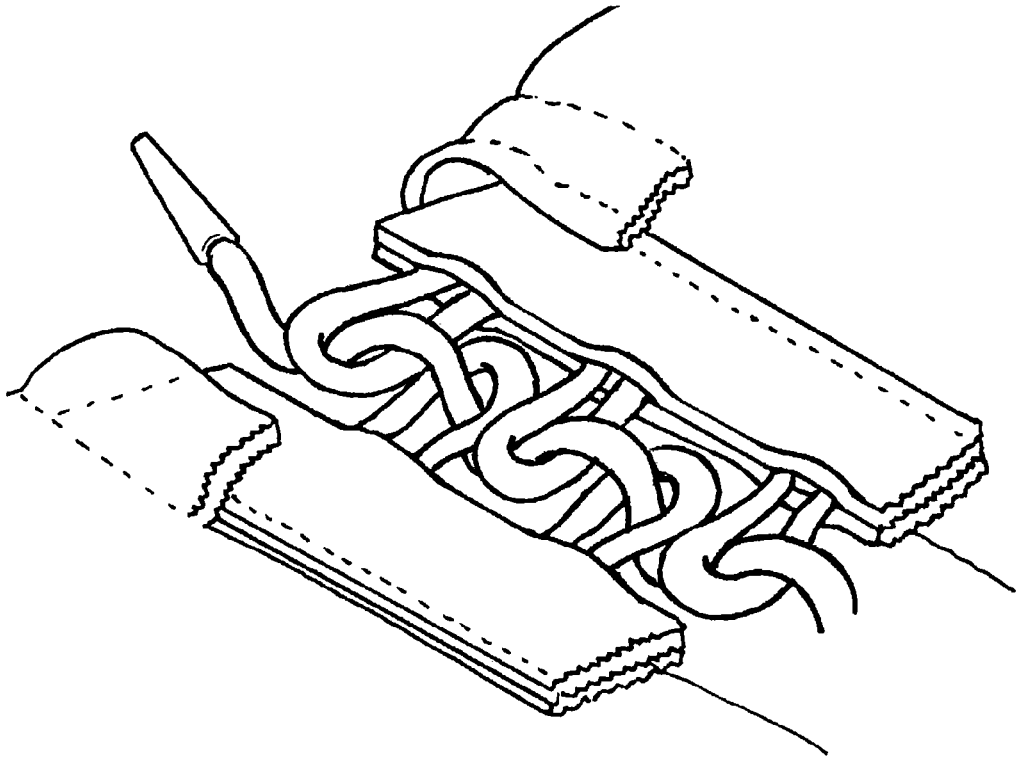
Figure 5E:
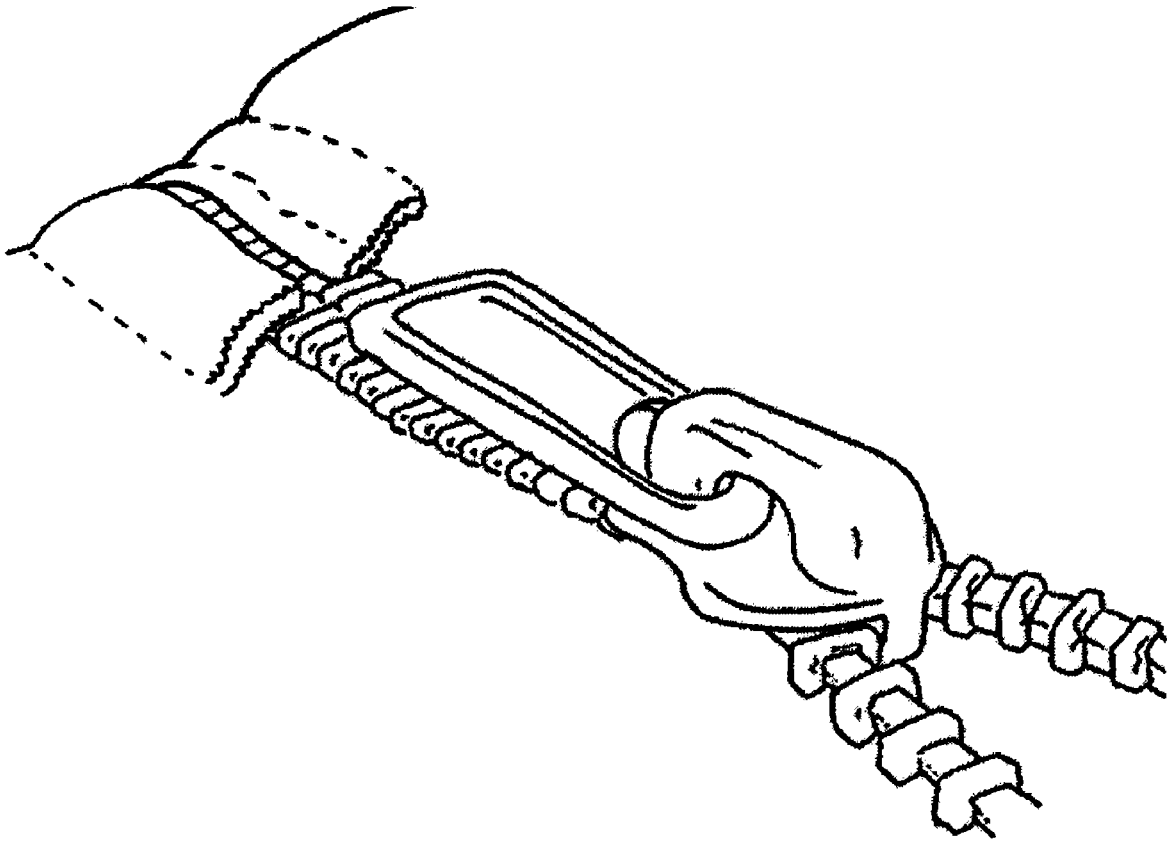

According to some embodiments, and as depicted in FIG. 1*b*, segmented sleeping bag 100 may be separated transversely into its constituent parts so that each of upper portion 110, middle portion 120, and lower portion 130 are separated from each other. The separated portions may be attached or reattached to each other via releasable connectors 115, 125 that may include connections such as snaps (FIG. 5*a*), hook and loop closures (FIG. 5*b*), and loop lacing (FIGS. 5*c* and 5*d*).

In some embodiments, mechanisms may be provided on the segmented sleeping bag 100 in order to provide insulation in the areas where the portions form a connection, e.g., where releasable connectors 115 and 125 are located. For example, in FIG. 1*b*, overlapping flaps 165*a*-*d* provide additional coverage in the areas where the portions couple together in order to avoid insulation gaps at the connection areas. This may be accomplished by configuring overlapping flaps 165*a*-*d* so that they extend around an outer circumference of each of upper, middle, and lower portions in a manner that parallels the areas of releasable connectors 115, 125. Thus, when the connections are made, overlapping flaps 165*a* and 165*b*, and 165*c* and 165*d* may be positioned so that they overlap each other. Moreover, overlapping flaps 165*a*-*c* may be configured to include drawstrings 160*a*-*c*, so that, for example, once overlapping flaps 165*a*-*d* are positioned, the drawstrings 160*a*-*c* may be tightened secure the overlapping flaps in position.

According to some embodiments, the upper, middle and lower portions of sleeping bag 100 may be used separately on a host sleeping bag, or individually, or may be used in combination with other portions.

Figure 2A:
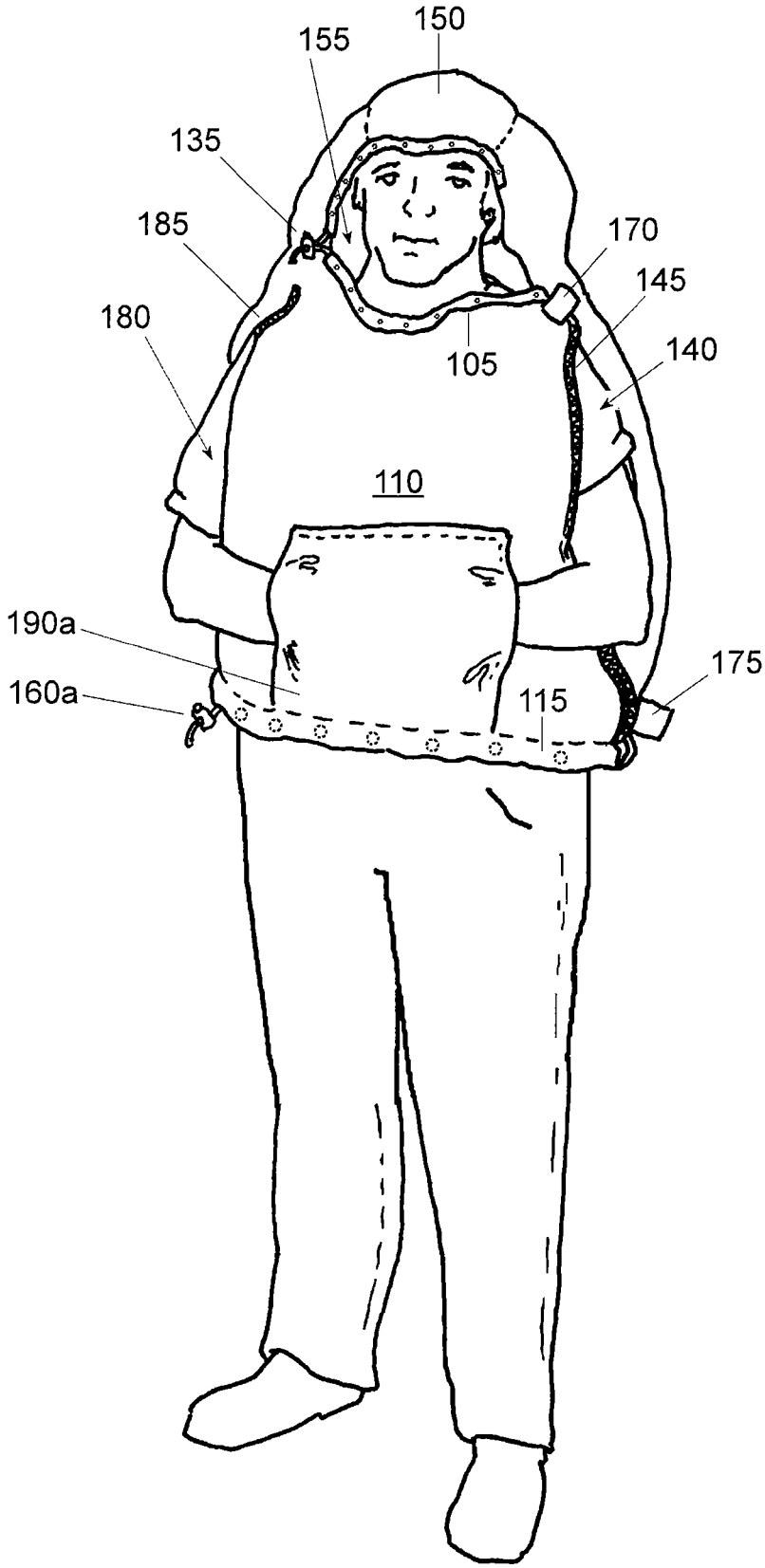
FIG. 2*a* depicts an exemplary use of an upper portion of the segmented bag.

In one example, depicted in FIG. 2*a*, upper portion 110 may be used as a jacket or parka because it includes arm openings 140 and 180, a hood 150 at a proximal end, and an adjustable opening at a distal end. According to this example, openings 140 and 180 may serve as arm holes for the parka and are formed by opening zipper closures 145 and 185, respectively. According to this embodiment, zipper closure 145 serves both as a vehicle for providing access to the fully assembled segmented sleeping bag, and as an opening for a user to extend their arm through. A separate zipper closure (not shown) may also be provided at or near zipper closure 185 in order to provide an opening for a user to extend their arm through. Zipper closures 145, 185 provide one example of a closing mechanism for openings 140 and 180. Other closure mechanisms such as snap buttons, Velcro, and hook and loop closures may also be provided.

The hood 150 has a drawstring 135 for adjusting the size of the opening 155 through which a user's head is exposed. Closure tab 170 serves to connect the areas of upper portion 110 at or near hood 150 and/or at the user's shoulder to allow upper portion 110 to be disposed on a user's body in a fashion similar to a parka. An additional closure tab 175 may also be provided in order to connect areas of the upper portion 110 at or near it's distal end so that at least part of the upper portion completely surrounds the circumference of a user's torso. Closure tabs may be constructed of materials such as hook and loop closures, quick snaps, buttons, or any fastening mechanism suitable for connecting two sides of upper portion 110 together. As an alternative to one or more of closure tabs 170 and 175, zipper closure 145 may be configured to close-off upper portion 110 at or near a user's shoulder and/or at or near the lower end of upper portion 110 while leaving opening 140 large enough to permit a user to extend their arm through.

Upper portion 110 farther includes drawstring 160*a* for adjusting the size of the opening at its distal end depending on the user's fit preference. Affixed pocket 190*a* is also provided on upper portion 110 and may serve both as a pocket for storing upper portion 110 when not in use, and as a place for a user to put their hands, for example.

Figure 2B:
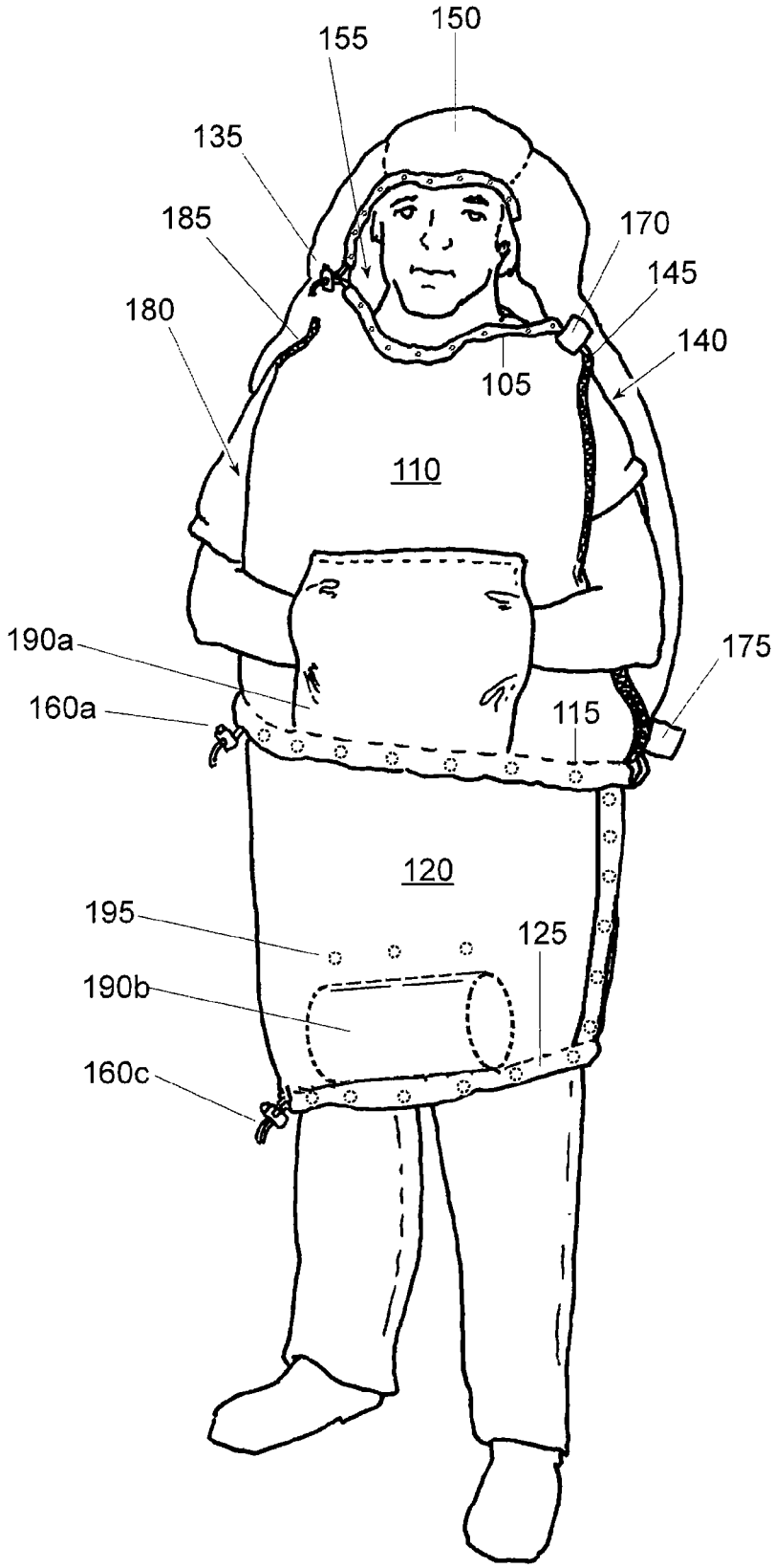
FIG. 2*b* depicts an exemplary use of a combined upper portion and middle portion of the segmented sleeping bag.

FIG. 2*b*. depicts another example of how the separated portions of the segmented sleeping bag 100 may be used. As can be seen in FIG. 2*b*, upper portion 110 and middle portion 120 are connected via releasable connectors 115, and lower portion 130 has been removed, leaving releasable connectors 125 in a released state. The combination of upper portion 110 and middle portion 120 forms a cagoule for a user to wear. The upper portion 110 of the cagoule may include the same features as the jacket or parka described in FIG. 2*a*, and further includes a middle portion 120 that surrounds a user's body down to an area at or near a user's knees. Middle portion 120 may include a drawstring 160*b* (not shown in FIG. 2*b*) located near the connection point between upper portion 110 and middle portion 120, and drawstring 160*c* located at or near the lower end of middle portion 120. Drawstring 160*b* and 160*c* serve as adjustment mechanisms to loosen or tighten the cagoule around the user's torso and legs, respectively, depending on the desired level of mobility, retained warmth, and/or fit. In addition, middle portion 120 may further include releasable connectors 195 in order to allow the middle portion 120 of the cagoule to be shortened, for example, to allow for more mobility by the user. These connectors 195 may be positioned inside the middle portion for selective attachment to the connectors 125.

According to additional implementations, segmented sleeping bag 100 may be used in combination with a host sleeping bag.

Figure 3A:
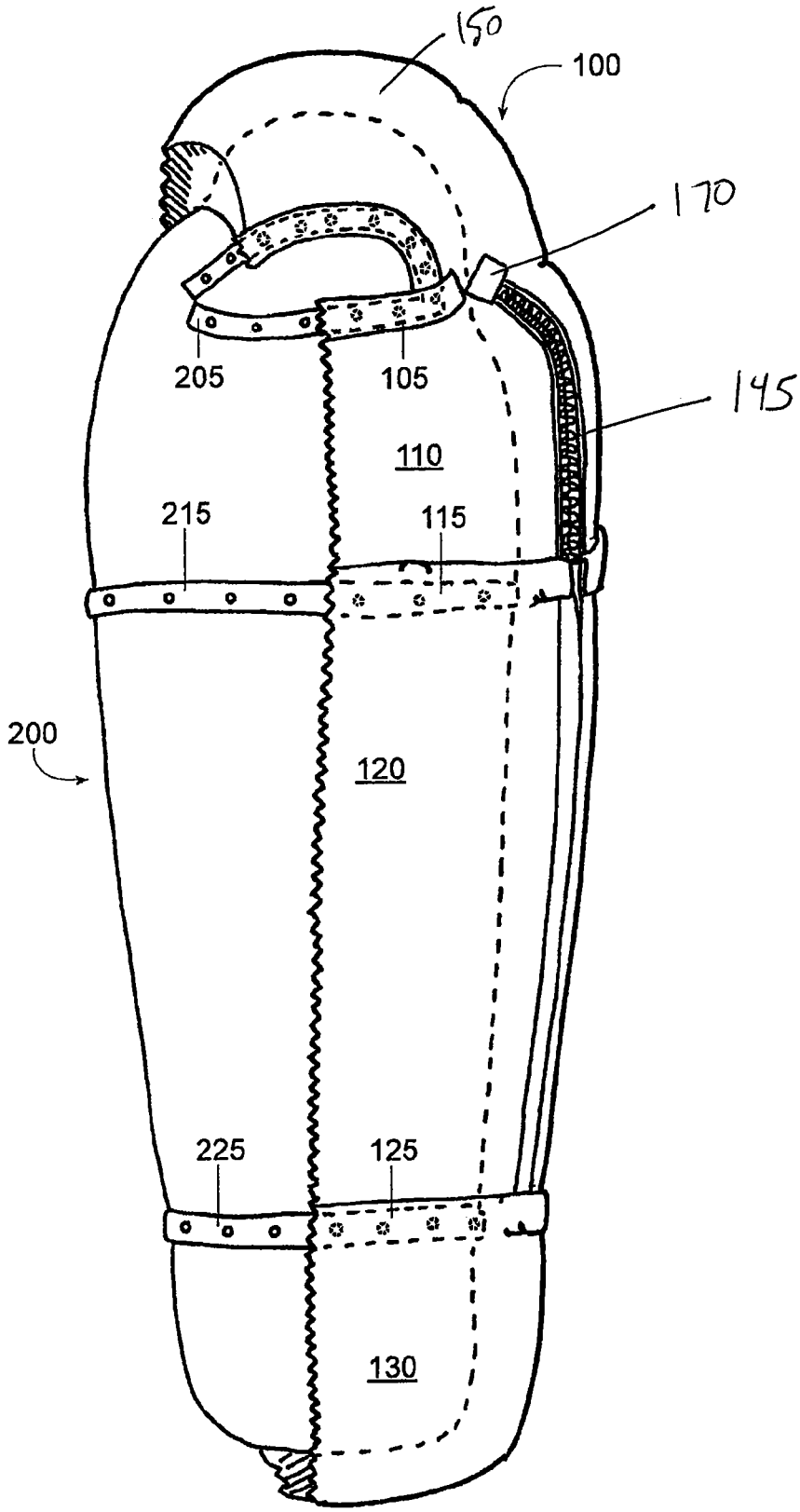
FIG. 3*a* depicts a cut-away view of an assembly of a fully assembled segmented sleeping bag and a host sleeping bag.

FIG. 3*a* depicts a cut-away view of a fully assembled segmented sleeping bag 100 and host sleeping bag 200, according to one embodiment. In some instances, host sleeping bag 200 may resemble a traditional sleeping bag capable of fitting inside of segmented sleeping bag 100 but not specifically configured for use with segmented sleeping bag 100. In other instances, host sleeping bag 200 is designed specifically to fit inside of and be used with segmented sleeping bag 100. In FIG. 3*a*, host sleeping bag 200 is configured for use with segmented sleeping bag 100 and includes releasable connectors 205, 215, 225 that are complementary to and positioned to correspond to the locations of the releasable connectors 105, 115, 125, respectively, on segmented sleeping bag 100. This allows host sleeping bag 200 to be coupled to segmented sleeping bag 100 so that, for example, when a person moves, the movement of host sleeping bag 200 is translated to segmented sleeping bag 100. This may prevent a person from orientating the host sleeping bag 200 in a way that makes it uncomfortable or difficult to exit the sleeping bag assembly.

Figure 3B:
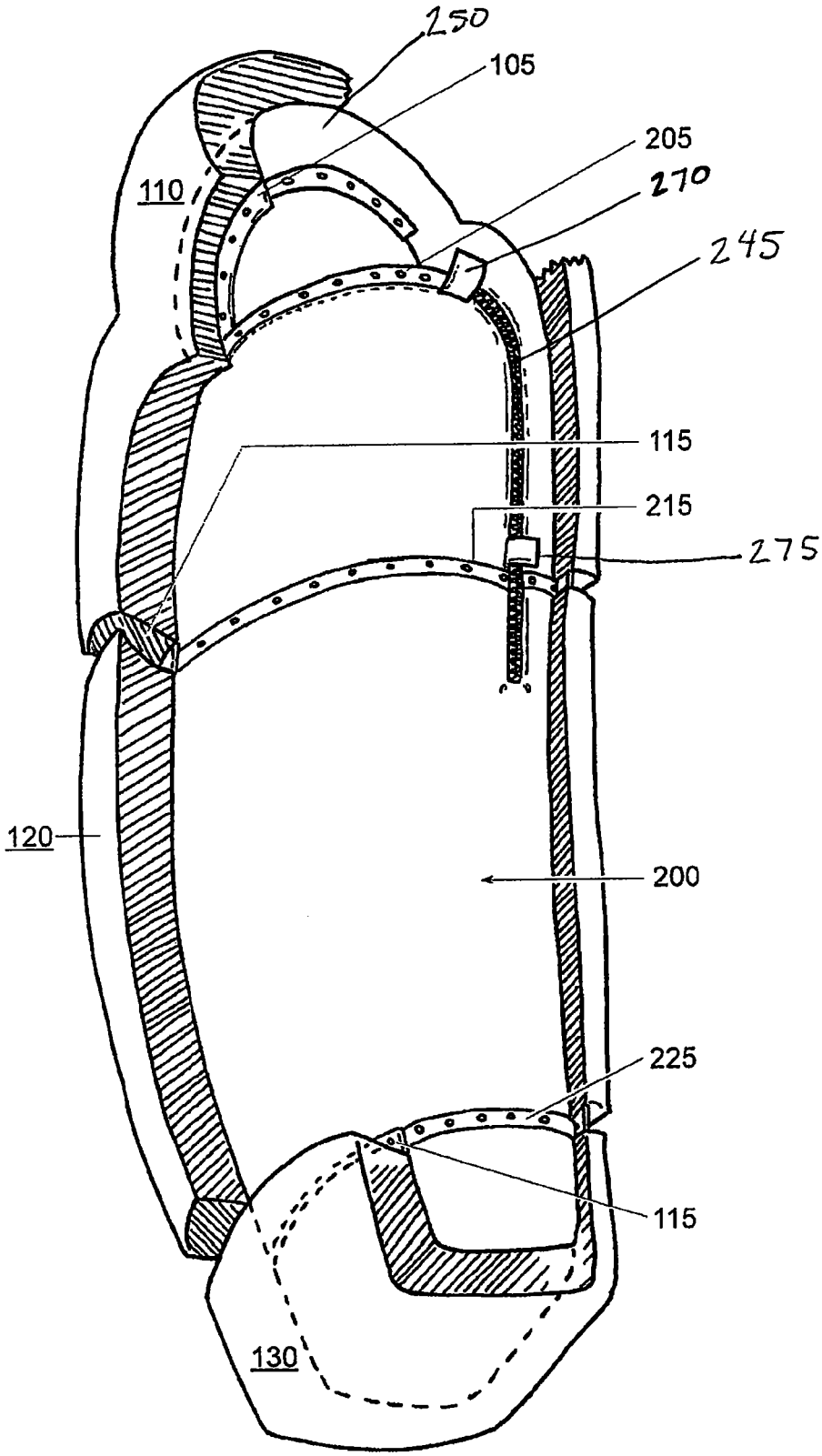
FIG. 3*b* depicts another cut-away view of an assembly of a fully assembled segmented sleeping bag and a host sleeping bag.

FIG. 3*b* depicts another cut-away view of a fully assembled segmented sleeping bag 100 and host sleeping bag 200 showing how the releasable connectors couple the segmented sleeping bag 100 and the host sleeping bag 200 together. According to FIG. 3*b*, releasable connectors 205 of host sleeping bag 200 releasably couple with releasable connectors 105 of segmented sleeping bag 100. Similarly, releasable connectors 215 and 225 of host sleeping bag 200 releasably couple with releasable connectors 115 and 125 of segmented sleeping bag 100, respectively. Furthermore, releasable connectors 115 releasably couple upper portion 110 with middle portion 120, and releasable connectors 125 releasably couple middle portion 120 with lower portion 130. As a result, the portions of the segmented sleeping bag 100 are coupled to each other and to the host sleeping bag. As can be seen from FIG. 3*b*, host sleeping bag 200 includes arm holes formed by opening zipper closures 245, integrated hood section 250 and closure tabs 270 and 275. As may be appreciated from a comparison of FIGS. 3*a* and 3*b*, each of arm holes formed by zipper closures 145, 245, integrated hood sections 150, 250 and closure tabs 170, 270 and 175 (not shown), 275 from segmented sleeping bag 100 and host sleeping bag 200, respectively, overlap one another in an assembled state.

Figure 3C:
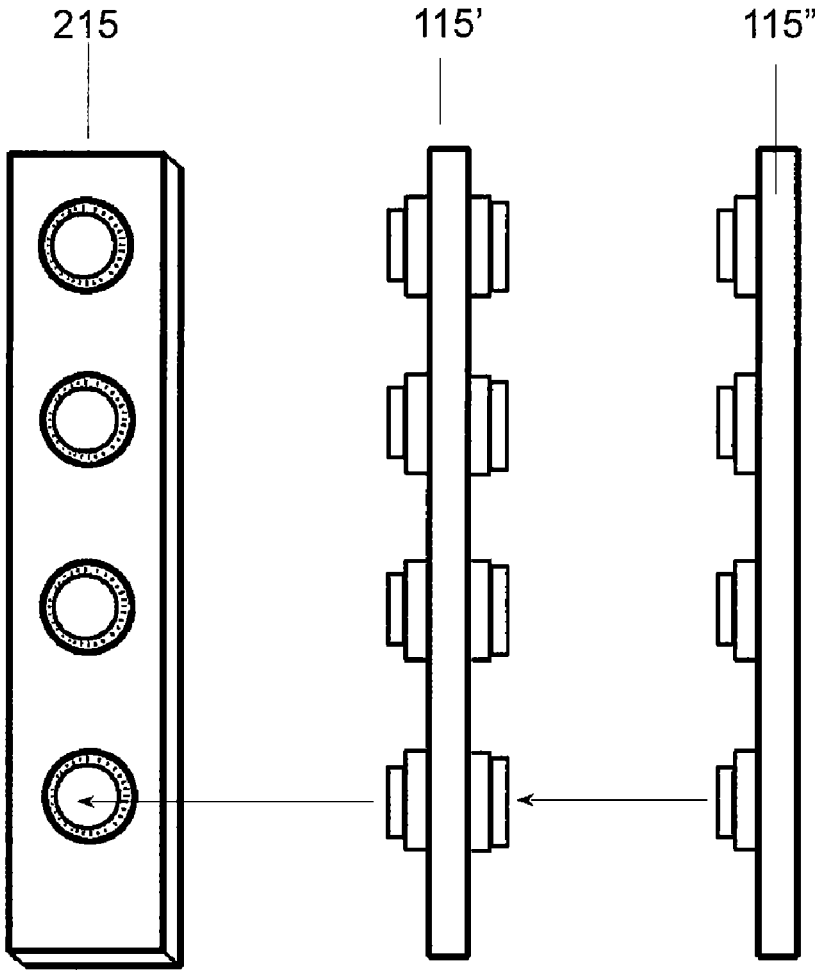
FIG. 3*c* depicts an attachment mechanism for use with a segmented sleeping bag and a host sleeping bag.

FIG. 3*c* depicts one connection mechanism enabling the portions of the segmented sleeping bag 100 to be coupled to each other and to the host sleeping bag 200. Releasable connectors 215 disposed on host sleeping bag 200 include one side of a set of snaps facing upward and extending along the outer circumference of host sleeping bag 200. Releasable connectors 115" disposed on middle portion 120 of segmented sleeping bag 100 also includes one set of snaps and extend along an inner circumference of middle portion. Releasable connectors 115' disposed on upper portion 110 of segmented sleeping bag 100 extend along the circumference of upper portion 110, and include two sets of snaps, where the first set faces releasable connectors 215 and the second set faces releasable connectors 115". According to this embodiment, the first set of releasable connectors 115' on upper portion 110 are complimentary to and releasably couple to the set of snaps serving as releasable connectors 215. The second set of releasable connectors 115' are complimentary to and releasably couple to releasable connectors 115" disposed on middle portion 120. When releasable connectors 115' couple to both releasable connectors 215 and releasable connectors 115", the upper portion 110 and middle portion 120 of segmented sleeping bag 100 are releasably coupled, and host sleeping bag 200 is releasably coupled to upper portion 110, and thus to segmented sleeping bag 100 when fully assembled.

Figure 3D:
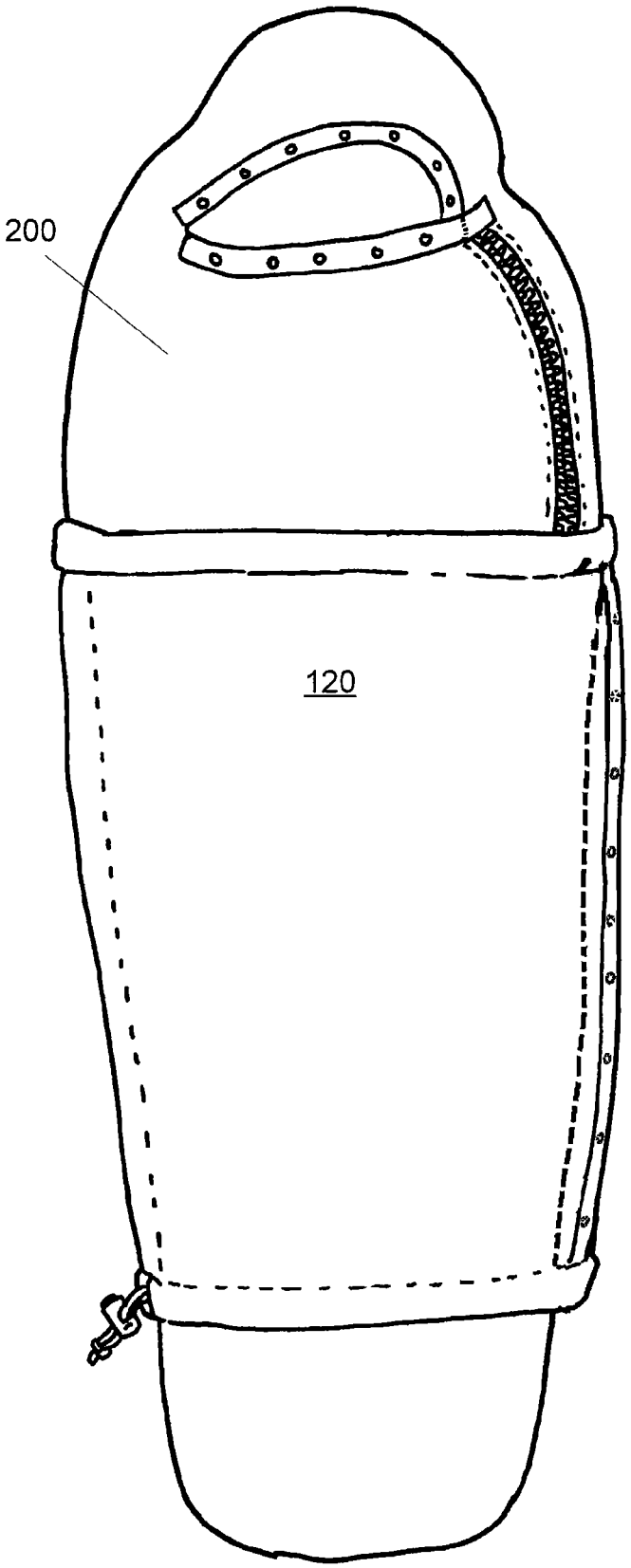
FIG. 3*d* depicts an assembly of a middle portion of the segmented sleeping bag and a host sleeping bag.

Because segmented sleeping bag 100 may be broken-down into its constituent parts, i.e. into a discrete upper portion 110, middle portion 120, and lower portion 130, and each may be separately coupled to host sleeping bag 200, compartmentalized use of the segmented sleeping bag 100 on host sleeping bag 200 may be employed. This may provide spot performance enhancement in the sleeping bag assembly in order to provide enhanced temperature-control, waterproofing, cushioning, and/or durability performance. For example, FIG. 3*d* depicts a sleeping bag assembly of a middle portion 120 of segmented sleeping bag 100 providing spot enhancement of temperature performance on host sleeping bag 200. This configuration may be useful for a user that is most comfortable with more insulation around their torso compared to the rest of their body.

In other embodiments, upper portion 110 of segmented sleeping bag 100 may be attached with host sleeping bag 200 to provide enhanced performance around the upper portion of the host sleeping bag 200 that covers a user's head and upper torso. Similarly, lower portion 130 may be coupled to host sleeping bag 200 to provide enhanced performance to the bottom portion of host sleeping bag 200 that surrounds a user's feet and lower legs. In certain aspects, combining one or more portions of the segmented sleeping bag 100 with the host sleeping bag 200 may result in improving the temperature rating of the host sleeping bag 200.

Moreover, it is possible for two portions of segmented sleeping bag to be coupled to host sleeping bag 200 separately or also to each other. For example, upper portion 110 and middle portion 120 may be coupled to each other via releasable connectors 115; and host sleeping bag 200 may couple to the combined upper and middle portions in a manner similar to the connection mechanism described in FIG. 3*c*.

Figure 4A:
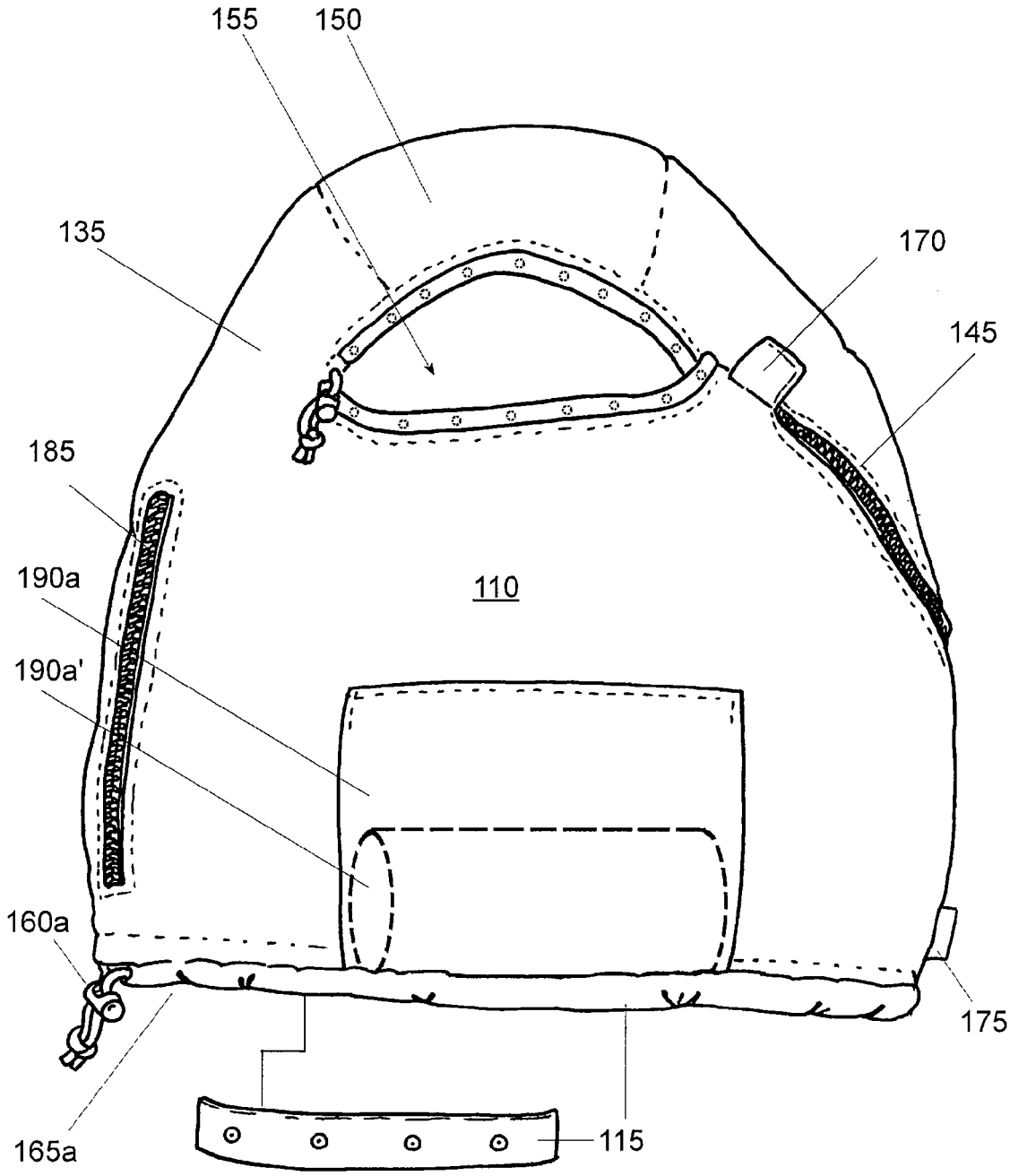
FIG. 4*a* depicts an upper portion of the segmented sleeping bag and an associated releasable connector.
Figure 4B:
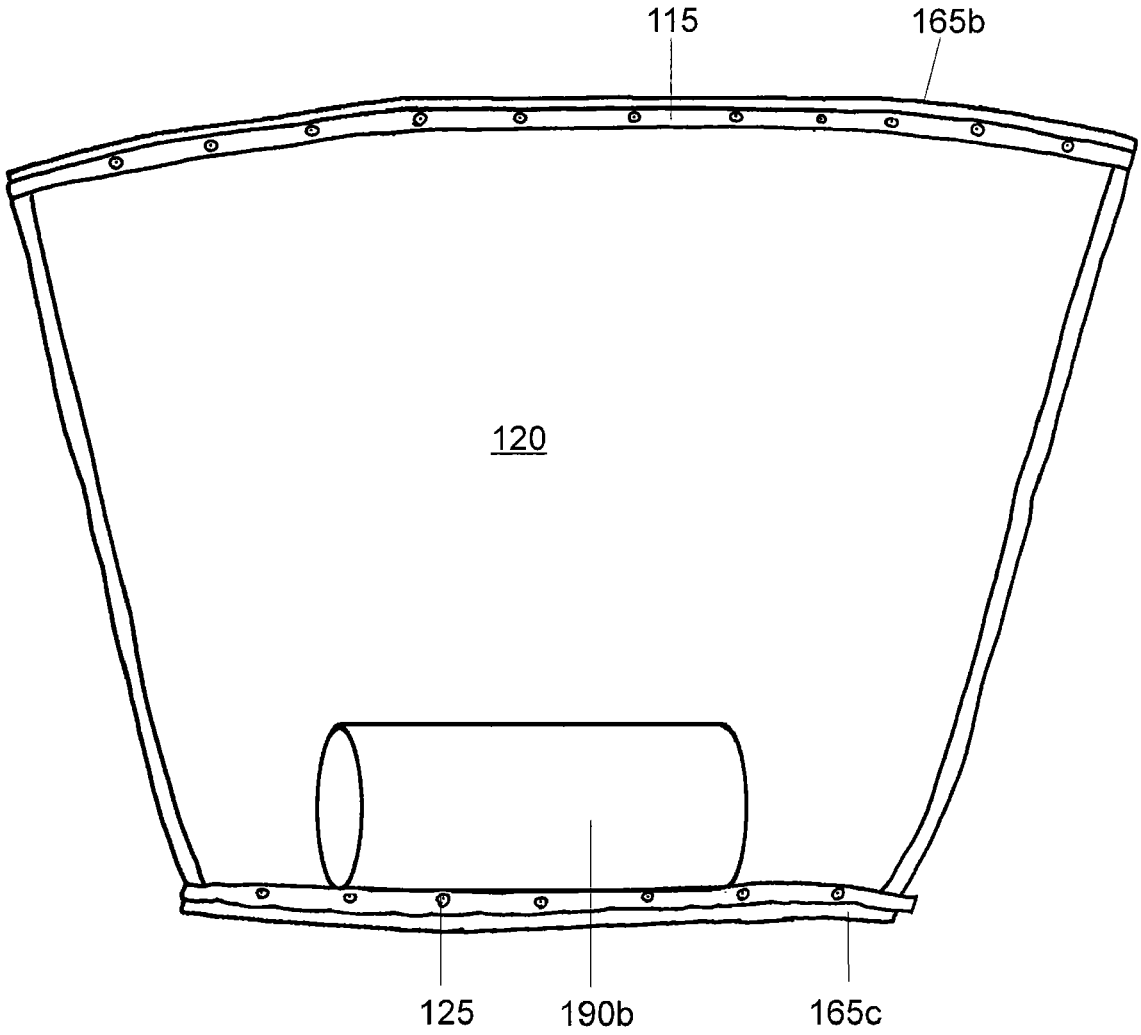
FIG. 4*b* depicts a middle portion of the segmented sleeping bag having positioned releasable connectors.

According to further embodiments, an existing sleeping bag not initially having releasable connectors may serve as a host sleeping bag 200. For example, a hunter who has used the same sleeping bag for years may keep his sleeping bag and add releasable connectors to it. As a result, the hunter's sleeping bag may serve as a host sleeping bag 200 capable of coupling to segmented sleeping bag 100. In one example, hook and loop portions may be fitted onto a hunter's existing sleeping bag in positions that correspond to areas of the segmented sleeping bag 100 having pre-existing complimentary hook and loop portions. This may provide for the incremental addition of increased performance of heat retention properties, waterproofing, cushioning and/or durability on the retrofitted host sleeping bag 200. In another example, both a hunter's sleeping bag and a segmented sleeping bag 100 may be retrofitted with releasable connectors so that the user can determine the positioning of the complementary releasable connectors on both the segmented sleeping bag 100 and the hunter's sleeping bag. FIG. 4*a* illustrates the addition of releasable connectors 115 to an existing upper portion 110 of the segmented sleeping bag 100. According to this embodiment, releasable connectors 115 may be affixed to upper portion 110 under flap 165*a*. In some instances, the releasable connectors 115 on upper portion 110 may be configured the same as in FIG. 3*c*, i.e., as releasable connectors 115', so that the upper portion may be combined with a host sleeping bag 200 and with middle portion 120. FIG. 4*b* illustrates middle portion 120 having been retrofitted with releasable connectors 115 attached at a proximal end, and releasable connectors 125 attached at a distal end. Releasable connectors 115 on middle portion 120 may also be configured the same as in FIG. 3*c*, i.e., as releasable connectors 115", so that the upper portion 110 releasable connectors 115' may releasably couple thereto.

Some implementations of the segmented sleeping bag may provide one or more reversible sections. This may allow a user to choose the appearance of the segmented bag when used for sleeping and when used as an article of clothing. In addition, the segmented sleeping bag, according to some aspects of the invention, may include additional storage areas, hooks, or clips for holding camping gear such as ammunition, fishing gear, or other articles commonly used when hunting or hiking.

It should be understood that the materials used to construct both the segmented sleeping bag and the host sleeping bag may be any materials suitable for a sleeping bag such as nylon, polyester, insulating materials, fleece, and various combinations of these and/or other suitable materials. For example, the materials may be selected depending on the desired level of temperature performance, waterproofing, cushioning, and/or durability. According to certain embodiments, materials chosen for use with a segmented sleeping bag may provide a high level of temperature performance, while materials chosen for use with a host sleeping bag may provide a high level of cushioning. In another example, both the segmented sleeping bag and the host sleeping bag are composed of materials that provide mid-level temperature performance so that in areas where the host sleeping bag receives a portion of the segmented sleeping bag, the combination provides a high level of temperature performance.

Furthermore, some implementations of a segmented sleeping bag may include portions that are constructed from materials different from other portions. For example, an upper and middle portion may be constructed of waterproof nylon, while the lower portion may be constructed of a high-performance insulation material. In yet another implementation, one side of a portion of the segmented sleeping bag 100 may be constructed of one material, and the other side of the portion may be constructed of another material. For example, an upper portion of a segmented sleeping bag may be constructed of waterproof nylon on a back side, while the front side is constructed with a breathable water-resistant fabric. Alternatively, a hood and shoulder area of the upper portion may be constructed of waterproof material, while the rest of the upper portion, i.e. the area surrounding the upper torso, may be constructed of breathable fleece.

Aspects of the invention enable a hunter to hike and camp with a host sleeping bag inserted into and/or releasably coupled to a segmented sleeping bag. This improves the heat retention properties of the host sleeping bag, and allows the hunter to use the upper portion or upper and middle portion of the segmented bag as a garment. The need to carry a jacket is thus eliminated, and the amount of bulk and weight carried by the hunter is reduced. In addition, the balance of the unused portion or portions of the segmented sleeping bag may be stored in an integrated storage pocket for easy stowing and transport. Including a segmented sleeping bag in a hunter's camping provisions may be helpful especially during transition seasons when the use of one or more portions of the segmented sleeping bag provides a desired amount of sleeping comfort and utility.

From the above description and drawings, it will be understood by those of ordinary skill in the art that the particular embodiments shown and described are for purposes of illustration only and are not intended to limit the scope of the present invention. Those of ordinary skill in the art will recognize that the present invention may be embodied in other specific forms without departing from its spirit or essential characteristics. References to details of particular embodiments are not intended to limit the scope of the invention.

What is claimed is:

1. A multi-purpose segmented sleeping bag comprising:

an upper portion having a first closure mechanism extending longitudinally on a first side of the upper portion for providing access to the segmented sleeping bag and for providing a first sealable arm opening, a second closure mechanism extending longitudinally on a second side of the upper portion for providing a second sealable arm opening, an integrated hood disposed at a proximal end of the upper portion, and an opened end defined by the distal end;

a middle portion, said middle portion configured as a sleeve and defining an opening at a proximal end and an opening at a distal end, the proximal end defining the opening configured to be releasably coupleable to the distal opened end of the upper portion;

a lower portion comprising a sleeve with a closed distal end and defining an opened proximal end, said opened proximal end configured to be releasably coupleable to the opening defined by the distal end of the middle portion; and a host sleeping bag, said host sleeping bag configured to be releasably coupleable to one or more of the upper, middle, and lower portion, and configured to provide for compartmentalized use of at least a portion of the host sleeping bag within any one or more of said portions;

wherein each of said upper, middle and lower portions are configured as discrete, coupleable segments, and when said middle portion is coupled to said upper portion and said lower portion, a hollow elongated sleeping bag is provided and configured to receive the host sleeping bag, wherein when said upper, middle or lower portion receives the host sleeping bag, spot performance enhancement is provided to an upper, a middle or a lower portion of the host sleeping bag, respectively, and wherein when said upper portion stands alone, a parka is formed.

2. The multi-purpose segmented sleeping bag of claim 1, wherein when said top portion and said middle portion are coupled and said lower portion detached, a cagoule is formed.

3. The multi-purpose segmented sleeping bag of claim 1, wherein the upper and middle and middle and lower portions are releasably coupleable via zippers.

4. The multi-purpose segmented sleeping bag of claim 1, wherein the upper and middle and middle and lower portions are releasably coupleable via quick snaps.

5. The multi-purpose segmented sleeping bag of claim 1, wherein the upper and middle and middle and lower portions are releasably coupleable via hook and loop closures.

6. The multi-purpose segmented sleeping bag of claim 1, wherein the upper and middle and middle and lower portions are releasably coupleable via loop lacing closures.

7. The multi-purpose segmented sleeping bag of claim 1, wherein the integrated hood is further configured with a drawstring for providing an adjustable opening.

8. The multi-purpose segmented sleeping bag of claim 1, wherein said distal end of said upper portion farther comprises a drawstring for adjusting the circumference of the upper portion at the distal end.

9. The multi-purpose segmented sleeping bag of claim 1, wherein each of said proximal end and said distal end of said middle portion further comprise a drawstring for adjusting the circumference of the middle portion at each of the proximal end and the distal end.

10. The multi-purpose segmented sleeping bag of claim 1, wherein each of said upper portion, middle portion, and lower portion further comprise a pocket.

11. A sleeping bag system comprising:

a segmented sleeping bag having an upper portion, a middle portion, and a lower portion, wherein said middle portion is releasably attached to said upper portion at a first end and is releasably attached to said lower portion at a second end; and a host sleeping bag configured to detachably couple to one or more of the upper, middle, and lower portions of the segmented sleeping bag and configured to provide for compartmentalized use of the host sleeping bag with any one or more of said portions, wherein each of said upper portion, middle portion, and lower portion comprises one or more sets of releasable connectors coupleable to the one or more sets of complementary releasable connectors on an upper, a middle and a lower portion of said host sleeping bag, respectively;

wherein when said segmented sleeping bag is assembled with said upper portion, middle portion, and lower portion, it provides a hollow elongated sack in which said host sleeping bag can be received and secured via the releasable connectors; and wherein any of the upper, middle, and/or lower portions may be detached to provide for compartmentalized use.

12. The sleeping bag system of claim 11, wherein said upper portion comprises an integrated hood section, said hood section comprising an opening with a set of releasable connectors coupleable to complementary releasable connectors on an integrated hood section of said host sleeping bag.

13. The sleeping bag system of claim 11, wherein said upper portion comprises a sealable opening extending longitudinally, and said host sleeping bag comprises a sealable opening extending longitudinally, and wherein said sealable opening of said segmented sleeping bag and said sealable opening of said host sleeping bag are positioned in general alignment to each other.

14. The sleeping bag system of claim 13, wherein one or more of said sealable openings comprise zipper openings.

15. The sleeping bag system of claim 13, wherein one or more of said sealable openings comprise quick snap openings.

16. The sleeping bag system of claim 11, wherein the upper and middle and middle and lower portions are releasably attached via zipper closures.

17. A multi-purpose heat retention system comprising:

an outer sleeping bag parka, said outer sleeping bag parka comprising:

at least two sealable arm openings;

an integrated hood section;

at least one resealable closure tab for defining a shoulder portion;

and one or more sets of releasable connectors;

wherein said outer sleeping bag parka defines an elongated sleeve terminating at one end by integrating with the integrated hood section and open end defined at the other end to provide an access opening having an adjustable circumference; and a host sleeping bag comprising at least one sealable arm opening, an integrated hood section, at least one resealable closure tab for defining a shoulder portion and one or more sets of complementary releasable connectors configured to couple with said outer sleeping bag parka releasable connectors inside of said outer sleeping bag parka such that the at least one sealable arm opening, the integrated hood section and the at least one resealable closure tab of the host sleeping bag and the outer sleeping bag parka are respectively aligned when the complementary releasable connectors and the outer sleeping bag parka releasable connectors are coupled, said outer sleeping bag parka providing heat retention properties to said host sleeping bag.

18. The multi-purpose article of claim 17, further comprising an outer sleeping bag sleeve, said outer sleeping bag sleeve comprising one or more sets of releasable connectors at a proximal end that are complementary to the one or more sets of releasable connectors on the outer sleeping bag parka, wherein said outer sleeping bag sleeve couples to said sleeping bag parka at said access opening to form a cagoule.

19. The multi-purpose article of claim 17, wherein said releasable connectors comprise zippers.

20. A sleeping bag system comprising:

an outer sleeping bag portion having an integrated hood section at a proximal end and an opening defined at a distal end; and a host sleeping bag having an integrated hood section, said host sleeping bag configured to detachably couple to the outer sleeping bag portion, wherein said outer sleeping bag portion is configured to receive a portion of said host sleeping bag around a circumference of said host sleeping bag such that the host sleeping bag protrudes from the opening defined at the distal end of the outer sleeping bag, and said integrated hood section defining an opening positioned complementary to an opening defined by the integrated hood section of the host sleeping bag; and wherein the integrated hood section of the outer sleeping bag portion and the host sleeping bag each comprise a set of releasable connectors spaced around the integrated hood sections defining the openings and coupleable to each other such that, upon coupling, the openings are aligned.

21. The sleeping bag system of claim 20, further comprising another outer sleeping bag portion, said another outer sleeping bag portion forming a sleeve and having a proximal end configured to be releasably coupleable to the distal end of the outer sleeping bag portion around the opening and/or to the host sleeping bag.

22. The sleeping bag system of claim 21, wherein the sleeve having the proximal end is configured to be releasably coupleable to the distal end of the outer sleeping bag portion around the opening and/or to the host sleeping bag via one or more zipper closures.

23. The sleeping bag system of claim 20, further comprising another outer sleeping bag portion forming a sleeve with a closed distal end, said another portion comprising a proximal end configured to be releasably coupleable to a distal end of said host sleeping bag.

* * * * *